US005480239A

United States Patent [19]

Kim et al.

[11] Patent Number: 5,480,239

[45] Date of Patent: Jan. 2, 1996

[54] POSTAGE METER SYSTEM HAVING BIT-MAPPED INDICIA IMAGE SECURITY

[75] Inventors: Hyung-Kun P. Kim, Wilton; Arno Muller, Westport, both of Conn.; Easwaran C. N. Nambudiri, Port Chester, N.Y.

[73] Assignee: Pitney Bowes Inc., Stamford, Conn.

[21] Appl. No.: 133,419

[22] Filed: Oct. 8, 1993

[51] Int. Cl.[6] ..... B41J 2/315

[52] U.S. Cl. ..... 400/120.09; 400/124.02; 400/76

[58] Field of Search ..... 101/71, 93; 400/121, 400/124, 61, 63, 76, 120.09, 124.02; 395/108, 110

[56] References Cited

U.S. PATENT DOCUMENTS

| | | | |
|---|---|---|---|
| 2,800,386 | 7/1957 | Wockenfuss | 346/141 |
| 4,167,342 | 9/1979 | Mower et al. | 400/124 |
| 4,251,874 | 2/1981 | Check, Jr. | 364/900 |
| 4,256,948 | 3/1981 | Wolf et al. | 219/121 LE |
| 4,268,180 | 5/1981 | Honma | 400/124 |
| 4,428,284 | 1/1984 | Thorne | 400/121 |
| 4,457,636 | 7/1984 | Nusser | 400/124 |
| 4,493,252 | 1/1985 | Clark | 101/71 |
| 4,508,463 | 4/1985 | Wang et al. | 400/124 |
| 4,637,051 | 1/1987 | Clark | 382/1 |
| 4,641,346 | 2/1987 | Clark et al. | 380/3 |
| 4,649,266 | 3/1987 | Eckert | 235/432 |
| 4,660,221 | 4/1987 | Dlugos | 380/23 |
| 4,725,718 | 2/1988 | Sansone et al. | 235/495 |
| 4,739,343 | 4/1988 | Dolan | 101/71 |
| 4,743,747 | 5/1988 | Fougere et al. | 235/494 |
| 4,757,537 | 7/1988 | Edelmann et al. | 380/51 |
| 4,775,246 | 10/1988 | Edelmann et al. | 380/23 |
| 4,813,912 | 3/1989 | Chickneas et al. | 364/464.02 |
| 4,829,568 | 5/1989 | Clark et al. | 380/23 |
| 4,835,713 | 5/1989 | Pastor | 364/519 |
| 4,949,381 | 8/1990 | Pastor | 380/51 |
| 5,075,862 | 12/1991 | Doeberl et al. | 395/117 |
| 5,186,498 | 2/1993 | Dietrich | 283/67 |

OTHER PUBLICATIONS

U.S. Patent Application Ser. No. 06/904,527 now abandoned.

*Primary Examiner*—Edgar S. Burr
*Assistant Examiner*—John S. Hilten
*Attorney, Agent, or Firm*—Charles G. Parks, Jr.; Melvin J. Scolnick; David E. Pitchenik

[57] ABSTRACT

A deterrent to counterfeiting of indicias on mailpieces is provided in a method and apparatus for implementing the printing of the indicia using a customized printhead or customized printer drivers such that the dots of the bit-mapped printing are produced by the printer in unevenly spaced rows or columns. The dot size may also be varied in accordance with data from the meter, printed value, variable data such as the date, and forensic data suitably encrypted. When the indicia is scanned, the variations are readily detectable and the information is easily extracted by Postal Authorities.

3 Claims, 3 Drawing Sheets

POSTAGE METER SYSTEM HAVING BIT-MAPPED INDICIA IMAGE SECURITY

FIELD OF THE INVENTION

The invention relates to postage metering systems and more particularly to postage metering systems which include bit-mapped printing of the meter indicias.

BACKGROUND OF THE INVENTION

Digital printing technology has made it possible to implement digital, i.e., bit map addressable, printing for the purpose of evidencing payment of postage by a postage-meter-like device. In order to distinguish such postage-meter-like devices from the typical postage meter which uses mechanical printing techniques, such devices will be named herein Postage Evidencing Devices or PED's. The computer driven printer can print the postal indicia in a desired location on the face of a mail piece. As used herein the postal indicia includes a Postal Revenue Block or PRB. The PRB typically contains data such as the postage value, a unique PED identification number, the date and in some applications the name of the place where the mail is originating.

From the Post Office's point of view, it will be appreciated that the digital printing makes it fairly easy to counterfeit an indicia with the PRB since any suitable computer may be used to generate multiple images.

It is known to prevent such counterfeiting by including certain information in the block in both plain text and cipher text. For example the postage amount, date and sequential piece count can be encrypted using either a secret or public key encryption algorithm and printed along with the plain text counterpart in the PRB. The value of the franking used in the encryption can be determined from the encryption to learn whether the value as printed on the mailpiece is correct. See, for example, U.S. Pat. Nos. 4,757,537 and 4,775,246 to Edelmann et al. as well as U.S. Pat. No. 4,649,266 to Eckert. It is also known to authenticate a mailpiece by including the address as a further part of the encryption as described in U.S. Pat. No. 4,725,718 to Sansone et al. and U.S. Pat. No. 4,743,747 to Fougere et al. The encrypted messages may be included in graphic form as disclosed in U.S. Pat. Nos. 4,835,713 and 4,949,381 to Pastor.

U.S. Pat. No. 5,075,862 to Doeberl et al. discloses a metering system which includes changes in the indicia, such as the printing or not printing of a star based on a suitable algorithm involving date and postage amount, for authentication the printing. U.S. Pat. No. 4,913,912 to Chickneas shows a secure meter separated from a printhead which prints a validation number at each printing for authorization of the printing.

U.S. Pat. Nos. 4,637,051, to Clark; 4,641,346 to Clark et al.; 4,829,568 to Clark et al.: and 4,660,221 to Dlugos teach the printing of indicia in human readable format wherein the dots forming the indicia are displaced in accordance with an a coded message which may be read with an overlay. The coded message may also be printed in barcode.

U.S. Pat. No. 5,186,498 to Dietrich discloses the forming of a characteristic identification pattern to be printed which includes an encrypted number representative of the machine and the fee amount and date of printing.

To authenticate a mailpiece using many of the foregoing encryption techniques, the verifying Authority must again generate the encryption from the plain text using the identical key used by the purported mailer. If the printed cipher text matches or if the graphical pattern matches an overlay, the mailpiece is verified. If there is no match then appropriate action may be initiated. Others require that a template be used to determine the encryption.

SUMMARY OF THE INVENTION

It has been found that a deterrent to counterfeiting of indicias on mailpieces can be provided by utilizing a novel method and apparatus for implementing the printing of the indicia using a customized printhead or customized printer drivers such that the dots of the bit-mapped printing are produced by the printer in unevenly spaced rows or columns. The dot size may also be varied in accordance with data from the meter, printed value, variable data such as the date, and forensic data suitably encrypted. When the indicia is scanned, the variations are readily detectable and the information is easily extracted by Postal Authorities.

It is therefore an object of the invention to provide a novel method for verification of the printing of a Postal Revenue Block on a mailpiece and apparatus for producing such verifiable Revenue Blocks.

These and other objects of the invention are realized in a printer for printing postal indicias comprising a matrix printer operative in conjunction with a computer for printing bit-mapped images, said printer including printing elements and drivers arranged to print a plurality of dots, the arrangement being such that the dots printed thereby have a predetermined characteristic relationship associated with the printer whereby a printed image comprised of a plurality of the dots has a characteristic texture.

In an aspect of the invention a variable separation of the dots comprises the characteristic relationship.

In another aspect the dot size is variable. With any of the relationships of the dots in accordance with the invention, the pattern may be scanned and the printed matter is validated on the basis of the match with an appropriate relationship of the printed dots.

DESCRIPTION OF THE PREFERRED EMBODIMENT

Figure 1:
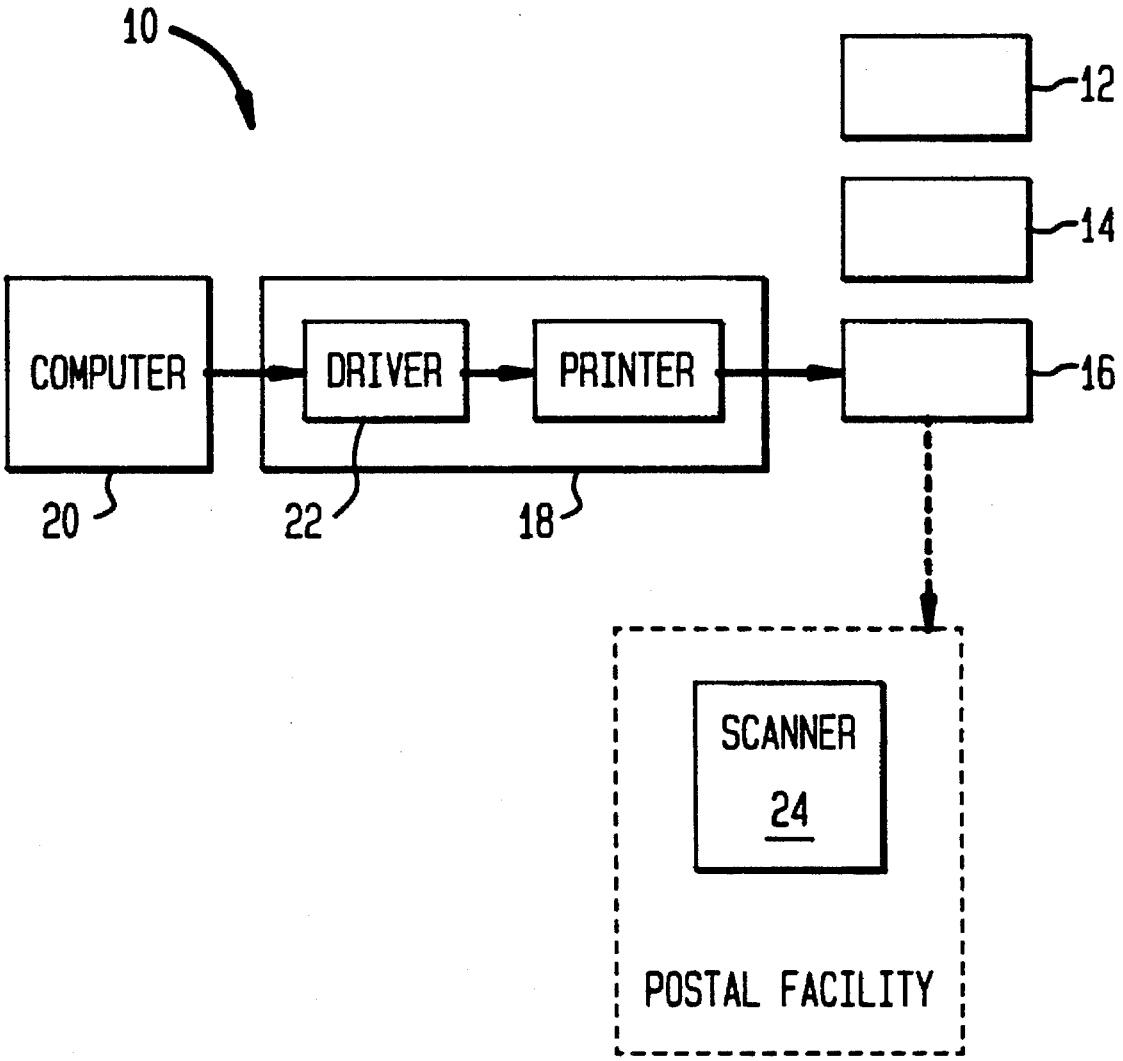
FIG. 1 is a schematic view of a system which may be used in accordance with the invention.

In FIG. 1, there is shown generally at 10 a system in accordance with the invention. Mailpieces 12, 14, and 16, which are representative of those to be sequentially printed during a batch run by a particular mailer are shown being fed to printer 18 for printing of a postal indicia by the printer which is suitably connected to computer 20 via drivers 22 in known manner as described for example in U.S. Pat. No. 4,757,537 to Edelmann et al or U.S. Pat. No. 4,831,555 to Sansone et al., specifically incorporated by reference herein.

Also in FIG. 1 there is shown a scanning device 24 which may be located at a postal facility, if desired, or at a forensic center at which determinations of the validity of an indicia on a mailpiece are to be made and which produces a video image which may be analyzed for forensic characteristics. Such a facility is described, for example in U.S. application Ser. No. 08/133,427, filed on Oct. 8, 1993, and assigned to the assignee of the instant application and specifically incorporated by reference herein. Scanning apparatus is well known and will not be further described herein.

Figure 2A:
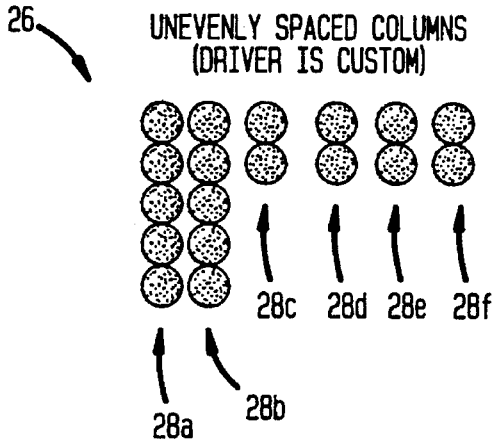
FIGS. 2*a* and 2*b* illustrate two typical dot position arrangements for printing in accordance with the invention.

FIG. 2*a* shows at 26 a portion of a bit-mapped print illustrating the output of a customized printer driver 18 printed on a mailpiece in which the columns 28*a* through 28*f* are unevenly spaced, preferably in a manner such that the output spacing may be associated with a particular printer, and suitably achieved by adjusting the timing of the print pulses. The dots will then be non-uniformly spaced in the direction of relative motion of the printer and mailpiece. A printer driver customized in this manner will produce an image that is difficult to scan and reprint.

Figure 2B:
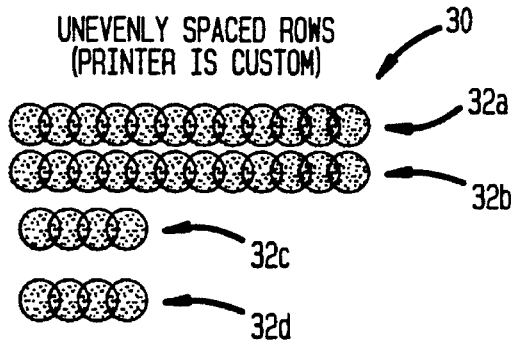

FIG. 2*b* illustrates at 30 a portion of a bit-mapped print output of a custom printer in which the rows 32*a* through 32*d* as shown are unevenly spaced. The spacing is chosen so as to be different from the spacing in commercial printers. A printer customized in this manner will make copying difficult.

It will be appreciated from the foregoing that whereas the normal goal of bit-mapped printing is to get very high-quality prints with the dots indiscernible, in accordance with the invention, the "texture" of the image is made difficult to duplicate. What is produced is a "signature" that is both machine and human-recognizable and difficult to copy without significant investment and expertise.

An advantage of the uneven spacing in accordance with the invention is that voluntary compliance with security regulations is encouraged since making an attempt to produce a copy will be evident to the potential counterfeiter as well as to anyone observing the image.

Figure 3:
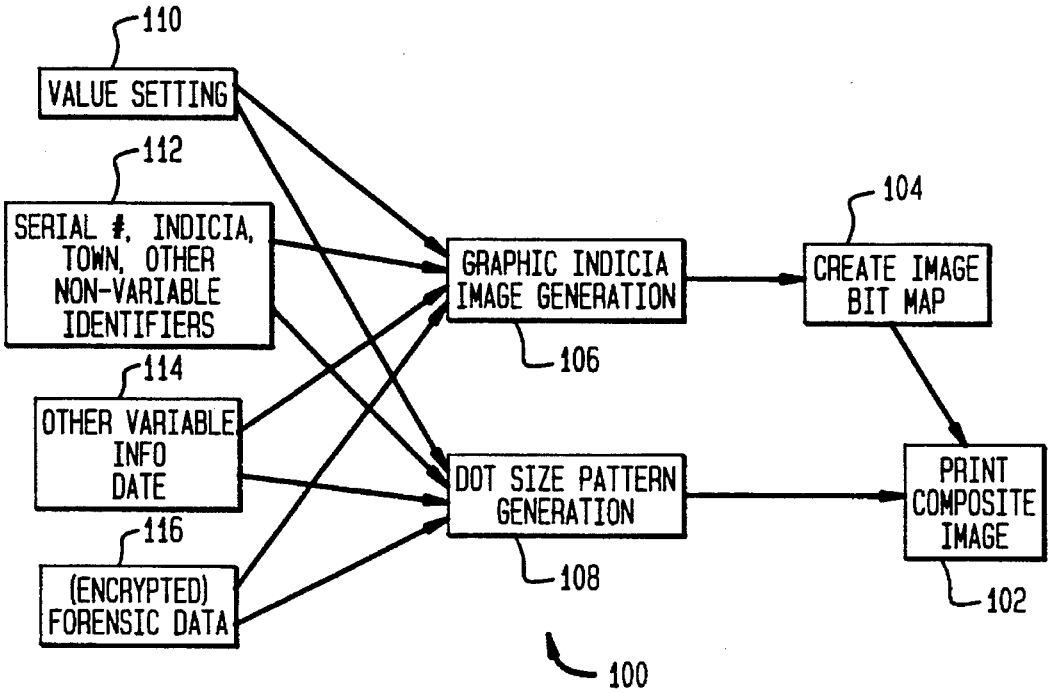
FIG. 3 is a block diagram of the generation of a composite image in accordance with the invention.

FIG. 3 shows generally at 100 a functional block diagram of another embodiment of a printing system in accordance with the invention. The composite print image printed at block 102 comprises both an image bit map created at block 104 from the graphic indicia image generator 106 and an input from dot-size pattern generator 108.

As illustrated both the graphic indicia image information and the dot size pattern can be comprised of appropriately formatted data such as the value to be printed, block 110; serial number or other non-variable identifiers, block 112; variable information including the date, block 114; and other forensic data which may be encrypted, block 116. The graphic image data may then be printed as described in connection with previously-cited patents and the U.S. application Ser. No. 08/133,427. The dot size may then be varied using conventional techniques in accordance with the pattern provided by the dot size pattern generator 108.

Figure 4:
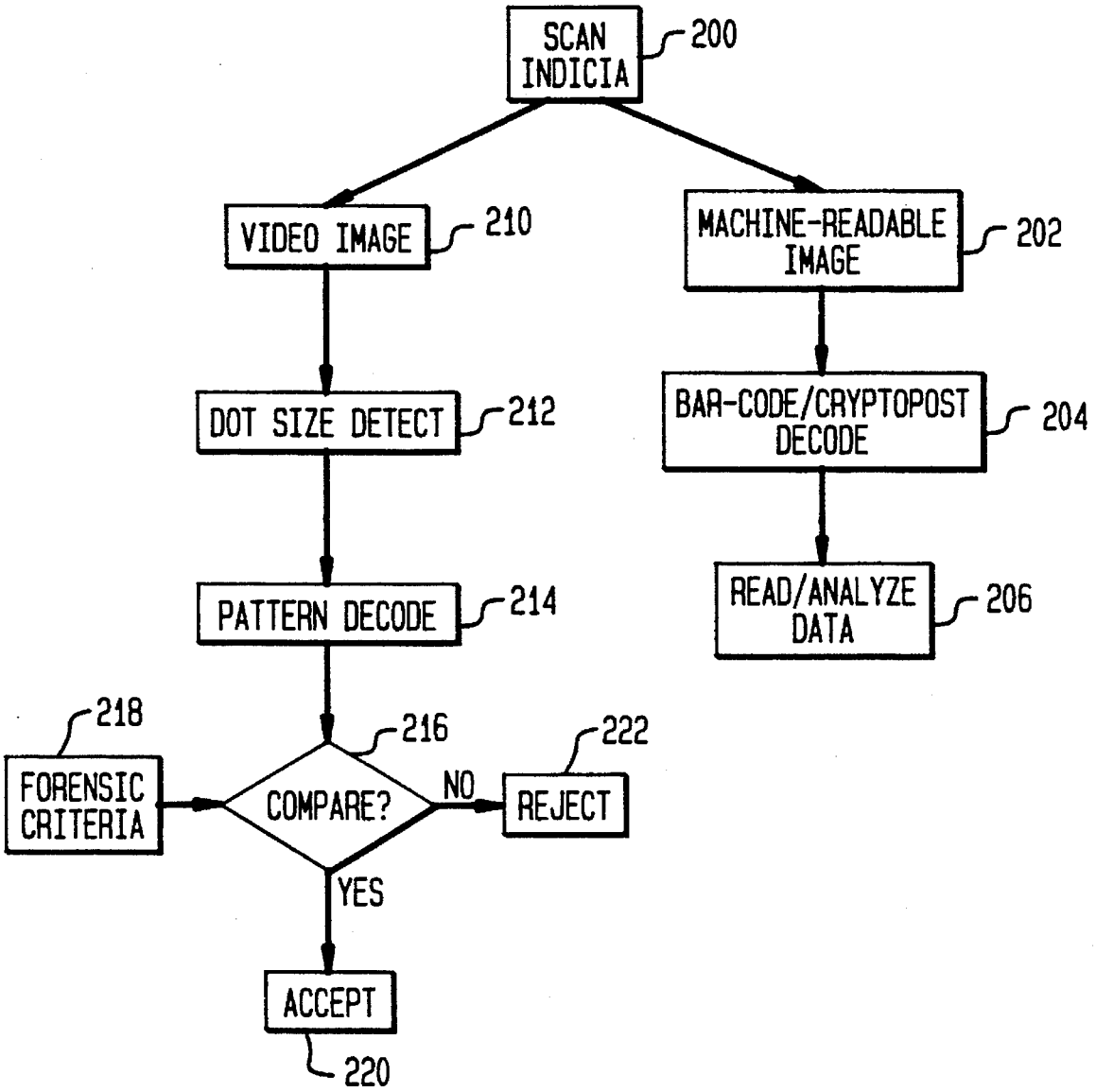
FIG. 4 is a flow chart of the operation of the printing of the authentication process in accordance with the invention.

FIG. 4 is a flow chart of the authentication of a mailpiece indicia in accordance with the invention.

The indicia is scanned at 200 and the treatment splits at that point into two paths. In one path, the machine-readable image is obtained, block 202 and the data is decoded or re-encrypted in dependence on the desired determination to be made, blocks 204 and 206.

In the other path, the video image is obtained, block 210, and from it the dot size or spacing is detected, block 212, and the pattern is decoded, block 214. The decoded pattern is compared at decision block 216 with forensic data input at block 218 and if there is a match, the Yes branch signals that the mailpiece is valid, block 220, and if there is no match, the No branch signals the rejection of the mailpiece, block 222.

What is claimed is:

1. A printer for printing a postal indicia comprising:

means to deter counterfeiting, said means including a computer printing bit map imaging means having a dot pattern image generator for generating a unique dot pattern information, and having a graphic image generator for generating graphical information, and print composite imaging means for receiving said graphical information and dot pattern information and creating composite printing information said dot pattern image generator causing said composite printing information to symmetrically vary dot position in accordance with variation in said dot pattern information;

a matrix printer operative in conjunction with said computer printing bit map imaging means;

said matrix printer including printing elements, a driver arranged for causing said matrix printer to print a plurality of dots in a pattern in accordance with said composite printing information from said composite imaging means.

2. The printer of claim 1 wherein said composite printing information causes said matrix printer to print a plurality of dots comprising said postage indicia wherein said dots sizes are caused to symmetrically vary to produce a texture in accordance with said composite printing information.

3. The printer of claim 2 or 1 wherein said composite printing information causes said matrix printer to print a plurality of dots comprising said postage indicia wherein said dots are positions in columns of symmetrically varying column spacing to produce a texture in accordance with said composite printing information.

* * * * *